US009249372B2

(12) United States Patent
Davies et al.

(10) Patent No.: US 9,249,372 B2
(45) Date of Patent: Feb. 2, 2016

(54) TITANIUM AND MOLYBDENUM COMPOUNDS AND COMPLEXES AS ADDITIVES IN LUBRICANTS

(75) Inventors: Mark C. Davies, Belper (GB); Virginia A. Carrick, Chardon, OH (US); Jody A. Kocsis, Chagrin Falls, OH (US); Patrick E. Mosier, Bay Village, OH (US); Matthew D. Gieselman, Wickliffe, OH (US); John K. Pudelski, Cleveland Heights, OH (US); Brent R. Dohner, Concord, OH (US); Jonathan S. Vilardo, Chardon, OH (US)

(73) Assignee: The Lubrizol Corporation, Wickliffe, OH (US)

( * ) Notice: Subject to any disclaimer, the term of this patent is extended or adjusted under 35 U.S.C. 154(b) by 222 days.

(21) Appl. No.: 13/582,517

(22) PCT Filed: Feb. 28, 2011

(86) PCT No.: PCT/US2011/026403

§ 371 (c)(1),
(2), (4) Date: Nov. 7, 2012

(87) PCT Pub. No.: WO2011/112372

PCT Pub. Date: Sep. 15, 2011

(65) Prior Publication Data

US 2013/0150273 A1 Jun. 13, 2013

Related U.S. Application Data

(60) Provisional application No. 61/312,369, filed on Mar. 10, 2010.

(51) Int. Cl.

| | |
|---|---|
| ***C10M 159/18*** | (2006.01) |
| ***C10L 1/18*** | (2006.01) |
| ***C10M 135/18*** | (2006.01) |
| ***C10M 129/02*** | (2006.01) |
| ***C10M 141/06*** | (2006.01) |
| ***C10M 141/08*** | (2006.01) |
| ***C10M 163/00*** | (2006.01) |

(52) U.S. Cl.

CPC ..... *C10M 135/18* (2013.01); *C10M 129/02* (2013.01); *C10M 141/06* (2013.01); *C10M 141/08* (2013.01); *C10M 163/00* (2013.01); *C10M 2203/1025* (2013.01); *C10M 2205/028* (2013.01); *C10M 2205/04* (2013.01); *C10M 2207/021* (2013.01); *C10M 2207/026* (2013.01); *C10M 2207/028* (2013.01); *C10M 2207/124* (2013.01); *C10M 2207/262* (2013.01); *C10M 2207/289* (2013.01); *C10M 2215/064* (2013.01); *C10M 2215/08* (2013.01); *C10M 2215/082* (2013.01); *C10M 2215/086* (2013.01); *C10M 2215/28* (2013.01); *C10M 2219/022* (2013.01); *C10M 2219/046* (2013.01); *C10M 2219/068* (2013.01); *C10M 2223/045* (2013.01); *C10N 2210/01* (2013.01); *C10N 2210/04* (2013.01); *C10N 2210/06* (2013.01); *C10N 2230/04* (2013.01); *C10N 2230/42* (2013.01); *C10N 2240/10* (2013.01)

(58) Field of Classification Search

CPC ..... C10M 2227/066
USPC ..... 508/230, 306
See application file for complete search history.

(56) References Cited

U.S. PATENT DOCUMENTS

| | | | | |
|---|---|---|---|---|
| 6,642,187 | B1 | 11/2003 | Schwind et al. | |
| 7,615,519 | B2 | 11/2009 | Eche et al. | |
| 7,615,520 | B2 | 11/2009 | Eche et al. | |
| 2006/0079413 | A1 | 4/2006 | Kocsis et al. | |
| 2006/0178278 | A1 * | 8/2006 | Kocsis et al. | 508/390 |
| 2006/0183647 | A1 * | 8/2006 | Kocsis et al. | 508/287 |
| 2006/0217271 | A1 | 9/2006 | Brown et al. | |
| 2007/0149418 | A1 | 6/2007 | Esche et al. | |
| 2008/0139429 | A1 * | 6/2008 | Guinther | 508/287 |
| 2008/0153722 | A1 | 6/2008 | Van Leeuwen et al. | |
| 2009/0318318 | A1 * | 12/2009 | Mathur et al. | 508/165 |

FOREIGN PATENT DOCUMENTS

| | | | |
|---|---|---|---|
| GB | 2444612 | | 6/2008 |
| JP | 2004149762 | | 5/2005 |
| WO | 2006/044411 | | 4/2006 |
| WO | 2009/042586 | | 4/2006 |
| WO | 2009/042590 | | 4/2006 |
| WO | 2006/105022 | A1 | 10/2006 |
| WO | 2008011338 | | 1/2008 |
| WO | 2008/147700 | A1 | 12/2008 |

OTHER PUBLICATIONS

Corresponding PCT Publication No. 2011/112372 A1 and Search Report published Sep. 15, 2011.
Written Opinion from corresponding International Application No. PCT/US2011/026403 dated Aug. 9, 2011.

* cited by examiner

*Primary Examiner* — Prem C Singh
*Assistant Examiner* — Francis C Campanell
(74) *Attorney, Agent, or Firm* — David M. Shold; Teresan W. Gilbert

(57) ABSTRACT

A lubricating composition comprising an oil of lubricating viscosity, 1 to 1000 parts per million by weight of titanium in the form of an oil-soluble titanium-containing material, and at least one additional lubricant additive provides beneficial effects on properties such as deposit control, oxidation, and filterability in engine oils.

16 Claims, No Drawings

TITANIUM AND MOLYBDENUM COMPOUNDS AND COMPLEXES AS ADDITIVES IN LUBRICANTS

BACKGROUND OF THE INVENTION

The disclosed technology relates to lubricant compositions containing a soluble titanium-containing material and a soluble molybdenum-containing material, having beneficial effects on properties such as deposit control, oxidation, and filterability in, for instance, lubricants for engines. Other materials used in combination with titanium are also useful in lubricants.

Current and proposed specifications for crankcase lubricants, such as GF-4 for passenger car motor oils, and PC-10 for heavy duty diesel engines specify increasingly stringent standards to meet government specifications. Of particular concern are sulfur and phosphorus limits. It is widely believed that lowering these limits may have a serious impact on engine performance, engine wear, and oxidation of engine oils. This is because historically a major contributor to phosphorus content in engine oils has been zinc dialkyldithiophosphate (ZDP), and ZDP has long been used to impart antiwear and antioxidancy performance to engine oils. Thus, as reduced amounts of ZDP are anticipated in engine oils, there is a need for alternatives to impart protection against deterioration in one or more of the properties of engine performance, engine wear, and oxidation of engine oils. Such improved protection is desirable whether or not ZDP and related materials are included in the lubricant. Desirable lubricants may be low in one or more of phosphorus, sulfur, and ash, that is, sulfated ash according to ASTM D-874 (a measure of the metal content of the sample).

US Published Application 2006-0217271, Brown et al., Sep. 28, 2006, discloses a lubricating composition comprising an oil of lubricating viscosity and 1 to 1000 parts per million by weight of titanium in the form of an oil-soluble titanium containing material. Additional additives may be present. A possible component may be an antioxidant, among which are disclosed phenolic antioxidants, aromatic amines, sulfurized olefins, and molybdenum compounds.

U.S. Pat. No. 7,615,520, Esche et al., Nov. 10, 2009, discloses a lubricated surface that includes a lubricant composition containing a base oil of lubricating viscosity and an amount of at least one hydrocarbon soluble metal compound effective to provide a reduction in oxidation of the lubricant composition. The metal of the metal compound is selected from the group consisting U.S. Pat. No. 7,615,519, Esche et al., Nov. 10, 2009, discloses a lubricated surface containing a base oil of lubricating viscosity and an amount of a hydrocarbon soluble titanium compound effective to provide a reduction in surface wear.

U.S. Patent 6,642,187, Schwind et al., Nov. 4, 2003, discloses lubricating compositions, concentrates, and greases containing the combination of an organic polysulfide and an overbased composition or a phosphorus or boron compound. Metals which can be used in the basic metal compound include (among others) titanium.

International PCT Publication WO 2006/044411, Apr. 27, 2006, discloses a low-sulfur, low-phosphorus, low-ash lubricant composition containing a tartrate ester or amide having 1 to 150 carbon atoms per ester or amide group. The lubricant composition is suitable for lubricating an internal combustion engine.

It has now been discovered that the presence of titanium, supplied, for instance, in the form of certain titanium compounds, provides a beneficial effect on one or more of the above properties. In particular, such materials as titanium isopropoxide or 2-ethylhexoxide impart a beneficial effect in one or more of the Komatsu Hot Tube Deposits screen test (KHT), the KES Filterability test, the Dispersant Panel Coker test (a test used to evaluate the deposit-forming tendency of an engine oil) and the Cat 1M-PC test. Combinations of such titanium compounds with other additives, to be described in detail below, can provide additional benefits as hereinafter described.

SUMMARY OF THE INVENTION

The disclosed technology provides a lubricating composition comprising: (a) an oil of lubricating viscosity; (b) about 20 to about 300 parts per million by weight of titanium in the form of an oil-soluble titanium-containing material; (c) about 40 to about 500 parts per million by weight molybdenum in the form of an oil-soluble molybdenum-containing material; and (d) about 0.3 to about 3 percent by weight of a hindered phenolic antioxidant.

The disclosed technology further provides a lubricating composition comprising: (a) an oil of lubricating viscosity; (b) about 200 to about 2000 parts per million by weight of titanium in the form of an oil-soluble titanium-containing material; and (h) about 0.1 to about 2.0 weight percent of a component comprising a hydroxycarboxylic acid or an ester, amide, imide, or salt thereof, or a derivative thereof with multiple of the foregoing functionalities.

In yet another embodiment, disclosed technology provides a lubricating composition comprising: (a) an oil of lubricating viscosity; and (b) about 20 to about 200 parts per million by weight of titanium in the form of an oil-soluble titanium-containing material; and (g) a sodium-containing detergent in an amount to contribute about 100 to about 2000 parts per million weight sodium to the composition.

In any of the foregoing embodiments, the titanium-containing material may have a molecular weight of less than 20,000.

The disclosed technology further provides a method for lubricating an internal combustion engine by supplying thereto the above-described lubricating composition.

DETAILED DESCRIPTION OF THE INVENTION

Various preferred features and embodiments will be described below by way of non-limiting illustration.

Unless otherwise indicated, each chemical or composition referred to herein should be interpreted as being a commercial grade material which may contain the isomers, by-products, derivatives, and other such materials which are normally understood to be present in the commercial grade. However, the amount of each chemical component is presented exclusive of any solvent or diluent oil, which may be customarily present in the commercial material, unless otherwise indicated.

One element of the disclosed technology is an oil of lubricating viscosity, also referred to as a base oil. The base oil used in the inventive lubricating oil composition may be selected from any of the base oils in Groups I-V as specified in the American Petroleum Institute (API) Base Oil Interchangeability Guidelines. The five base oil groups are as follows:

| Base Oil Category | Sulfur (%) | | Saturates (%) | Viscosity Index |
|---|---|---|---|---|
| Group I | >0.03 | and/or | <90 | 80 to 120 |
| Group II | ≤0.03 | and | ≥90 | 80 to 120 |
| Group III | ≤0.03 | and | ≥90 | ≥120 |
| Group IV | All polyalphaolefins (PAOs) | | | |
| Group V | All others not included in Groups I, II, III or IV | | | |

Groups I, II and III are mineral oil base stocks. The oil of lubricating viscosity, then, can include natural or synthetic lubricating oils and mixtures thereof. Mixture of mineral oil and synthetic oils, particularly polyalphaolefin oils and polyester oils, are often used. In certain embodiments, the oil may be a Group II or Group III base oil, which materials may be hydro-refined or severely hydro-refined.

Natural oils include animal oils and vegetable oils (e.g. castor oil, lard oil and other vegetable acid esters) as well as mineral lubricating oils such as liquid petroleum oils and solvent-treated or acid treated mineral lubricating oils of the paraffinic, naphthenic or mixed paraffinic-naphthenic types. Hydrotreated or hydrocracked oils are included within the scope of useful oils of lubricating viscosity.

Oils of lubricating viscosity derived from coal or shale are also useful. Synthetic lubricating oils include hydrocarbon oils and halosubstituted hydrocarbon oils such as polymerized and interpolymerized olefins and mixtures thereof, alkylbenzenes, polyphenyl, (e.g., biphenyls, terphenyls, and alkylated polyphenyls), alkylated diphenyl ethers and alkylated diphenyl sulfides and their derivatives, analogs and homologues thereof.

Alkylene oxide polymers and interpolymers and derivatives thereof, and those where terminal hydroxyl groups have been modified by, for example, esterification or etherification, constitute other classes of known synthetic lubricating oils that can be used.

Another suitable class of synthetic lubricating oils that can be used comprises the esters of dicarboxylic acids and those made from C5 to C12 monocarboxylic acids and polyols or polyol ethers. Other synthetic lubricating oils include liquid esters of phosphorus-containing acids, polymeric tetrahydrofurans, silicon-based oils such as the poly-alkyl-, polyaryl-, polyalkoxy-, or polyaryloxy-siloxane oils, and silicate oils.

Hydrotreated naphthenic oils are also known and can be used, as well as oils prepared by a Fischer-Tropsch gas-to-liquid synthetic procedure followed by hydroisomerization.

Unrefined, refined and rerefined oils, either natural or synthetic (as well as mixtures of two or more of any of these) of the type disclosed herein-above can used in the compositions of the disclosed technology. Unrefined oils are those obtained directly from a natural or synthetic source without further purification treatment. Refined oils are similar to the unrefined oils except they have been further treated in one or more purification steps to improve one or more properties. Rerefined oils are obtained by processes similar to those used to obtain refined oils applied to refined oils which have been already used in service. Such rerefined oils often are additionally processed by techniques directed to removal of spent additives and oil breakdown products.

The disclosed technology also comprises titanium in the form of an oil-soluble titanium-containing material or, more generally, a hydrocarbon-soluble material By "oil-soluble" or "hydrocarbon soluble" is meant a material which will dissolve or disperse on a macroscopic or gross scale in an oil or hydrocarbon, as the case may be, typically a mineral oil, such that a practical solution or dispersion can be prepared. In order to prepare a useful lubricant formulation, the titanium material should not precipitate or settle out over a course of several days or weeks. Such materials may exhibit true solubility on a molecular scale or may exist in the form of agglomerations of varying size or scale, provided however that they have dissolved or dispersed on a gross scale.

The nature of the oil-soluble titanium-containing material can be diverse. Among the titanium compounds that may be used in—or which may be used for preparation of the oils-soluble materials of—the disclosed technology are various Ti (IV) compounds such as titanium (IV) oxide; titanium (IV) sulfide; titanium (IV) nitrate; titanium (IV) alkoxides such as titanium methoxide, titanium ethoxide, titanium propoxide, titanium isopropoxide, titanium butoxide, titanium 2-ethylhexoxide; and other titanium compounds or complexes including but not limited to titanium phenates; titanium carboxylates such as titanium (IV) 2-ethyl-1-3-hexanedioate or titanium citrate or titanium oleate; and titanium (IV) (triethanolaminato)isopropoxide. Other forms of titanium encompassed within the disclosed technology include titanium phosphates such as titanium dithiophosphates (e.g., dialkyldithiophosphates) and titanium sulfonates (e.g., alkylbenzenesulfonates), or, generally, the reaction product of titanium compounds with various acid materials to form salts, especially oil-soluble salts. Titanium compounds can thus be derived from, among others, organic acids, alcohols, and glycols. Ti compounds may also exist in dimeric or oligomeric form, containing Ti—O—Ti structures. Such titanium materials are commercially available or can be readily prepared by appropriate synthesis techniques which will be apparent to the person skilled in the art. They may exist at room temperature as a solid or a liquid, depending on the particular compound. They may also be provided in a solution form in an appropriate inert solvent.

In another embodiment, the titanium can be supplied as a Ti-modified dispersant, such as a succinimide dispersant. Such materials may be prepared by forming a titanium mixed anhydride between a titanium alkoxide and a hydrocarbyl-substituted succinic anhydride, such as an alkenyl- (or alkyl) succinic anhydride. The resulting titanate-succinate intermediate may be used directly or it may be reacted with any of a number of materials, such as (a) a polyamine-based succinimide/amide dispersant having free, condensable —NH functionality; (b) the components of a polyamine-based succinimide/amide dispersant, i.e., an alkenyl- (or alkyl-)succinic anhydride and a polyamine, (c) a hydroxy-containing polyester dispersant prepared by the reaction of a substituted succinic anhydride with a polyol, aminoalcohol, polyamine, or mixtures thereof. Alternatively, the titanate-succinate intermediate may be reacted with other agents such as alcohols, aminoalcohols, ether alcohols, polyether alcohols or polyols, or fatty acids, and the product thereof either used directly to impart Ti to a lubricant, or else further reacted with the succinic dispersants as described above. As an example, 1 part (by mole) of tetraisopropyl titanate may be reacted with 2 parts (by mole) of a polyisobutene-substituted succinic anhydride at 140-150° C. for 5 to 6 hours to provide a titanium modified dispersant or intermediate. The resulting material (30 g) may be further reacted with a succinimide dispersant from polyisobutene-substituted succinic anhydride and a polyethylenepolyamine mixture (127 g+diluent oil) at 150° C. for 1.5 hours, to produce a titanium-modified succinimide dispersant.

In another embodiment, the titanium can be supplied as a tolyltriazole oligomer salted with and/or chelated to titanium. The surface active properties of the tolyltriazole allow it to act as a delivery system for the titanium, imparting both the titanium performance benefits as elsewhere described herein, as well as anti-wear performance of tolyltriazole. In one embodiment, this material can be prepared by first combining tolyltriazole (1.5 eq) and formaldehyde (1.57 eq) in an inert solvent followed by addition of diethanolamine (1.5 eq) and then hexadecyl succinic anhydride (1.5 eq) and a catalytic amount of methane-sulfonic acid, while heating and removing water of condensation. This intermediate can be reacted with titanium isopropoxide (0.554 eq) at 60° C., followed by vacuum stripping to provide a red viscous product.

In one embodiment, the titanium is not a part of or affixed to a long-chain polymer, that is, a high molecular weight polymer. Thus, the titanium species may, in these circumstances, have a number average molecular weight of less than 20,000 or 10,000 or 5000, or 3000 or 2000, e.g., about 1000 or less than 1000. Non-polymeric species providing the titanium as disclosed above will typically be below the molecular weight range of such polymers. For example, a titanium tetraalkoxide such as titanium isopropoxide may have a number average molecular weight of 1000 or less, or 300 or less, as may be readily calculated. A titanium-modified dispersant, as described above, may include a hydrocarbyl substituent derived from a hydrocarbon with a number average molecular weight of 3000 or less or 2000 or less, e.g., about 1000.

In one embodiment, the oil-soluble titanium-containing mixture comprises a titanium (IV) alkoxide or carboxylate or mixtures thereof. In another embodiment, the oil-soluble titanium-containing material comprises titanium (IV) isopropoxide or 2-ethylhexoxide or mixtures thereof.

The amount of titanium present in the lubricant may typically be, in certain embodiments, 20 to 300 parts per million by weight (ppm), alternatively 30 to 200 or 40 to 150 or 50 to 140 ppm. That is, the titanium-containing material may be present in amounts suitable to provide the aforementioned amounts of titanium to the lubricant composition. These amounts may be particularly suitable when the titanium-containing material is used in combination with a molybdenum-containing material, as described below. In other embodiments, the amount of the titanium-containing material be those amounts suitable to provide 200 to 2000 parts per million by weight titanium, or alternatively 300 to 900 ppm or 400 to 800 ppm or 500 to 700 ppm. These amounts may be particularly suitable when the titanium-containing material is used in combination with a hydroxycarboxylic acid or an ester, amide, imide, or salt thereof, or derivative thereof with multiple of the foregoing functionalities, as described in greater detail below. In yet other embodiments, the amount of the titanium-containing material may those amounts suitable to provide 20 to 200 parts per million by weight of titanium to the lubricant composition, or alternatively 60 to 100 ppm or 50 to 90 ppm. These amounts may be particularly suitable when the titanium-containing material is used in combination with a sodium-containing detergent, as described in greater detail below. In a broad sense, the amount of titanium present in the lubricant may be 1 to 1000 parts per million by weight (ppm), alternatively 10 to 500 ppm or 10 to 150 ppm or 20 to 500 ppm or 20 to 300 ppm or 30 to 100 ppm or, again, alternatively, 50 to 500 ppm. It is believed that many of the cleanliness/anti-fouling/antioxidation benefits observed from the disclosed technology may be obtained even at relatively low concentrations of titanium, e.g., 5 to 100 or 8 to 50 or 8 to 45 or 10 to 45 or 15 to 30 or 10 to 25 parts per million of titanium, or 1 to less than 50 parts per million, or 8 to less than 50 parts per million by weight Ti.

These limits may vary with the particular system investigated and may be influenced to some extent by the anion or complexing agent associated with the titanium. As will be apparent, the actual amount of the particular titanium compound to be employed will depend on the relative weight of the anionic or complexing groups associated with the titanium. Titanium isopropoxide, for instance, is typically commercially supplied in a form which contains 16.8% titanium by weight. Thus, if amounts of 20 to 100 ppm of titanium are to be provided, about 119 to about 595 ppm (that is, about 0.01 to about 0.06 percent by weight) of titanium isopropoxide would be used, and so on. Such calculations are within the ability of the person skilled in the art.

Likewise, different performance advantages may be obtained by using different specific titanium compounds, that is, with different anionic portions or complexing portions of the compound. For example, tolyltriazole oligomers salted with and/or chelated to titanium may impart antiwear properties. In a like manner, titanium compounds containing relatively long chain anionic portions or anionic portion containing phosphorus or other anti-wear elements may impart antiwear performance by virtue of the anti-wear properties of the anion. Examples would include titanium neodecanoate; titanium 2-ethylhexoxide; titanium (IV) 2-propanolato, tris-isooctadecanato-O; titanium (IV) 2,2(bis-2-prepenolatomethyl)butanolato, tris-neodecanato-O; titanium (IV) 2-propanolato, tris(dioctyl)phosphato-O; and titanium (IV) 2-propanolato, tris(dodecyl)-benzenesulfanato-O. When any such anti-wear-imparting materials are used, they may be used in an amount suitable to impart—and should in fact impart—a reduction in surface wear greater than surface of a lubricant composition devoid of such compound.

In certain embodiments, the titanium-containing material may be selected from the group consisting of titanium alkoxides, titanium modified dispersants, titanium salts of aromatic carboxylic acids (such as benzoic acid or alkyl-substituted benzoic acids), and titanium salts of sulfur-containing acids (such as those of the formula R—S—R'—$CO_2H$, where R is a hydrocarbyl group and R' is a hydrocarbylene group).

The titanium compound can be imparted to the lubricant composition in any convenient manner, such as by adding to the otherwise finished lubricant (top-treating) or by preblending the titanium compound in the form of a concentrate in an oil or other suitable solvent, optionally along with one or more additional components such as an antioxidant, a friction modifier such as glycerol monooleate, a dispersant such as a succinimide dispersant, or a detergent such as an overbased sulfurized phenate detergent. Such additional components, typically along with diluent oil, may typically be included in an additive package, sometimes referred to as a DI (detergent-inhibitor or dispersant-inhibitor) package.

In one embodiment, the disclosed technology contains, in addition to the titanium-containing material, a molybdenum-containing material. Molybdenum compounds can also may serve as antioxidants, and these materials may also serve in various other functions, such as antiwear agents. The use of molybdenum and sulfur containing compositions in lubricating oil compositions as antiwear agents and antioxidants is known. Such a materials may be a molybdenum hydrocarbyldithiocarbamate. U.S. Pat. No. 4,285,822, for instance, discloses lubricating oil compositions containing a molybdenum and sulfur containing composition prepared by (1) combining a polar solvent, an acidic molybdenum compound and an oil-soluble basic nitrogen compound to form a molybdenum-containing complex and (2) contacting the complex with carbon disulfide to form the molybdenum and sulfur containing composition. Other molybdenum-containing materials include molybdenum dihydrocarbyldithio-phosphates. Yet other molybdenum-containing materials include molybdenum-amine compounds as described in U.S. Pat. No.

6,329,327; organomolybdenum compounds made from the reaction of a molybdenum source, fatty oil, and a diamine as described in U.S. Pat. No. 6,914,037; and trinuclear molybdenum-sulfur complexes as described in U.S. Pat. No. 6,232,276.

In certain embodiments, the lubricant formulation contains a molbydenum-containing material in an amount to provide 40 to 500 parts per million by weight molybdenum to the lubricant, or alternatively 50 to 250, 60 to 200, or 70 to 150 parts per million. The actual amount of the molybdenum-containing material will (as in the case of the titanium-containing material) depend in part on the nature and formula weight of the anion or complexing agent associated with the molybdenum, in a way that may be readily calculated.

In certain embodiments, the present technology may include the presence of a hydroxycarboxylic acid or an ester, amide, imide, or salt thereof, or a derivative thereof with multiple of the foregoing functionalities. Such materials and their syntheses are known from, for instance, International PCT Publication WO 2006/044411 and International Application PCT US 2009/067091. They have been employed in lubricants for their properties as thermal or oxidative stability, deposit control, and friction control.

Examples of suitable hydroxy-carboxylic acids include citric acid, tartaric acid, lactic acid, malic acid, glycolic acid, hydroxy-propionic acid, hydroxyglutaric acid, and mixtures thereof. Oligomers of such acids may also be employed (e.g, the self-condensate of glycolic acid by ester formation). In one embodiment an amide, ester or imide derivative of a hydroxy-carboxylic acid may be derived from tartaric acid, citric acid, hydroxy-succinic acid, dihydroxy mono-acids, mono-hydroxy diacids, or mixtures thereof. In one embodiment the amide, ester or imide derivative of a hydroxy-carboxylic acid includes a derivative (or compound derived from) tartaric acid or citric acid, or, in another embodiment, from tartaric acid.

In one embodiment the amide, ester or imide derivative of a hydroxy-carboxylic acid may be represented by Formula (1) (encompassing, 1a or 1b):

Formula (1a)

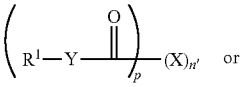

or

Formula (1b)

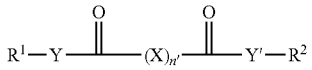

wherein n' is 0 to 10 for Formula (1b), and 1 to 10 for Formula (1a); p is 1 to 5; Y and Y' are independently —O—, >NH, >NR3, or an imide group formed by taking together both Y and Y' groups in (1b) or two Y groups in (1a) and forming a $R^1$—N<group between two >C═O groups; X is independently —$CH_2$—, >$CHR^4$, >$CR^4R^5$, >$CHOR^6$, >C(OH)$CO_2R^6$, >$C(CO_2R^6)_2$, —$CH_3$, —$CH_2R^4$ or $CHR_4R^5$, —$CH_2OR^6$, —$CH(CO_2R^6)_2$, ≡C—$R^6$ (where ≡ refers to three valences, and may only apply to Formula (1a)), or mixtures thereof, to fulfill the valence of Formula (1a) and/or (1b) (the compound of Formula (1a) or (1b) may have at least one X that is hydroxyl-containing (i.e., >$CHOR^6$, wherein $R^6$ is hydrogen)); $R^1$ and $R^2$ are independently hydrocarbyl groups, typically containing 1 to 150, or 4 to 30, or 8 to 15 carbon atoms; $R^3$ is a hydrocarbyl group; $R^4$ and $R^5$ are independently keto-containing groups (such as acyl groups), ester groups, hydrocarbyl groups, —$OR^6$, —$CO_2R^6$, or —OH (typically not more than one —OH when X is >$CR^4R^5$); and $R^6$ is independently hydrogen or a hydrocarbyl group, typically containing 1 to 150, or 4 to 30, or 8 to 15 carbon atoms.

In one embodiment the compound of Formula (1) contains an imide group, which may be formed by taking together the Y and Y' groups and forming a $R^1$—N<group between two >C═O groups. In one embodiment the compound of Formula (1) has m, n, X, and $R^1$, $R^2$ and $R^6$ defined as follows: m is 0 or 1, n is 1 to 2, X is >$CHOR^6$, and $R^1$, $R^2$ and $R^6$ are independently hydrocarbyl groups containing 4 to 30 carbon atoms. In one embodiment Y and Y' are both —O—. In one embodiment the compound of Formula (1) has m, n, X, Y, Y' and $R^1$, $R^2$ and $R^6$ defined as follows: m is 0 or 1, n is 1 to 2, X is >$CHOR^6$; Y and Y' are both —O—, and $R^1$, $R^2$ and $R^6$ are independently hydrogen or hydrocarbyl groups containing 4 to 30 carbon atoms.

The di-esters, di-amides, ester-amide, ester-imide compounds of Formula (1) may be prepared by reacting a dicarboxylic acid (such as tartaric acid), with an amine or alcohol, optionally in the presence of a known esterification catalyst. In the case of ester-imide compounds it is necessary to have at least three carboxylic acid groups (such as provided by citric acid). The amine or alcohol which is reacted typically has sufficient carbon atoms to fulfill the requirements of $R^1$ and/or $R^2$ as defined in Formula (1).

In one embodiment $R^1$ and $R^2$ are independently linear or branched hydrocarbyl groups. In one embodiment they are branched; in another they are linear; or some may be branched and some linear. The $R^1$ and $R^2$ may be incorporated into Formula (1) by either an amine or an alcohol. The alcohol includes both monohydric alcohol and polyhydric alcohol. The carbon atoms of the alcohol may be linear chains, branched chains, or mixtures thereof.

Examples of suitable alcohols include 2-ethylhexanol, isotridecanol, Guerbet alcohols, methanol, ethanol, propanol, butanol, pentanol, hexanol, heptanol, octanol, nonanol, decanol, undecanol, dodecanol, tridecanol, tetradecanol, pentadecanol, hexadecanol, heptadecanol, octadecanol, nonadecanol, eicosanol, ethylene glycol, propylene glycol, 1,3-butylene glycol, 2,3-butylene glycol, 1,5-pentane diol, 1,6-hexane diol, glycerol, sorbitol, pentaerythritol, trimethylolpropane, starch, glucose, sucrose, methylglucoside, or mixtures thereof. In one embodiment a polyhydric alcohol is used in a mixture along with a monohydric alcohol; in such a combination the monohydric alcohol may constitute at least 60 or at least 90 mole percent of the mixture.

If the acid employed is tartaric acid, it may be a commercially available material, and it may exist in one or more isomeric forms such as d-tartaric acid, l-tartaric acid, d,l-tartaric acid or a racemic mixture of d-tartaric acid and l-tartaric acid, or mesotartaric acid.

In certain embodiments, the hydroxycarboxylic acid derivative may comprise a tartrimide such as a tartimide formed from a primary amine having 8 to 24 carbon atoms or 12 to 20 carbon atoms or 16 to 18 carbon atoms or mixtures thereof. In one embodiment, the tartrimide is oleyl tartrimide. In other embodiments, the hydroxycarboxylic acid derivative may comprise a tartrate ester such as a diester of tartaric acid and one or more alcohols having 8 to 24 carbon atoms or 8 to 18 carbon atoms or 12 to 14 carbon atoms. In one embodiment the tartrate is the ester from mixed C12-C14 alcohols.

The amount of the hydroxycarboxylic acid or derivative as described above, present in a lubricating composition along with the titanium-containing material, may be 0.1 to 2.0 percent by eight, or 0.2 to 1.5, or 0.3 to 1.0, or 0.4 to 0.7 weight percent.

The presence of the hydroxycarboxylic acid or derivative as described herein, along with titanium, particularly at a level of titanium greater than 100 parts per million by weight, is believed to impart oxidative stability to a lubricant, beyond the stabilization imparted by either the acid or derivative alone or the titanium alone. This effect may be observed using an oxidation induction time test in a pressurized differential scanning calorimeter. It may be observed in particular in amounts of titanium of 200 to 2000 ppm, or 200 to 1000 ppm, or 300 to 900 ppm or 400 to 800 ppm or 500 to 700 ppm titanium.

The advantages of the present technology relating to combinations of titanium and hydroxycarboxylic acid or derivative as described above may encompass lubricant formulations in which any or all of the other lubricant additives described herein are present or are absent. Thus, such lubricants may also include a metal-containing detergent other than a titanium-containing detergent, in particular, a sodium-containing detergent or other source of sodium, in the amounts set forth elsewhere herein. Such lubricants may also contain a molybdenum-containing material to provide molybdenum in amounts set forth elsewhere herein. They may also contain both the sodium and molybdenum components. Any of the foregoing may also contain a hindered phenolic antioxidant as described elsewhere herein.

The material present technology may also contain an antioxidant. While certain antioxidants may contain titanium, in certain embodiments the antioxidant which may be present is other than a titanium-containing antioxidant. That is, although a Ti-containing antioxidant may or may not be present in the lubricant, in certain embodiments a different, or additional antioxidant may be present which does not contain titanium.

Antioxidants encompass phenolic antioxidants, which may be of the general the formula

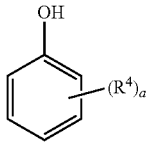

wherein $R^4$ is an alkyl group containing 1 to 24, or 4 to 18, carbon atoms and a is an integer of 1 to 5 or 1 to 3, or 2. The phenol may be a butyl substituted phenol containing 2 or 3 t-butyl groups, such as

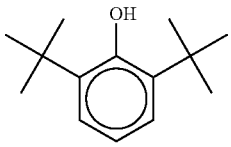

The para position may also be occupied by a hydrocarbyl group or a group bridging two aromatic rings. In certain embodiments the para position is occupied by an ester-containing group, such as, for example, an antioxidant of the formula

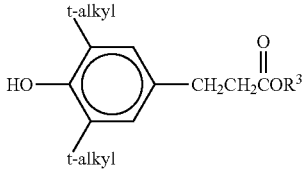

wherein $R^3$ is a hydrocarbyl group such as an alkyl group containing, e.g., 1 to 18 or 2 to 12 or 2 to 8 or 2 to 6 carbon atoms; and t-alkyl can be t-butyl. Among suitable $R^3$ groups are n-butyl, iso-octyl, and 2-ethylhexyl groups. (The material in which $R^3$ is n-butyl may be referred to as a C4 ester.) Such hindered phenolic ester antioxidants are described in greater detail in U.S. Pat. No. 6,559,105.

Antioxidants also include aromatic amines, such as those of the formula

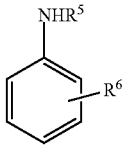

wherein $R^5$ can be an aromatic group such as a phenyl group, a naphthyl group, or a phenyl group substituted by $R^7$, and $R^6$ and $R^7$ can be independently a hydrogen or an alkyl group containing 1 to 24 or 4 to 20 or 6 to 12 carbon atoms. In one embodiment, an aromatic amine antioxidant can comprise an alkylated diphenylamine such as nonylated diphenylamine of the formula

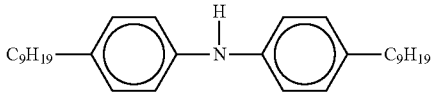

or a mixture of a di-nonylated amine and a mono-nonylated amine.

Antioxidants also include sulfurized olefins such as mono-, or disulfides or mixtures thereof. These materials generally have sulfide linkages having 1 to 10 sulfur atoms, for instance, 1 to 4, or 1 or 2. Materials which can be sulfurized to form the sulfurized organic compositions of the disclosed technology include oils, fatty acids and esters, olefins and polyolefins made thereof, terpenes, or Diels-Alder adducts. Details of methods of preparing some such sulfurized materials can be found in U.S. Pat. Nos. 3,471,404 and 4,191,659.

In certain embodiments, the materials of the present technology may contain, in particular, a hindered phenolic antioxidant, and, further, in certain embodiments, the hindered phenolic antioxidant may be a hindered phenolic ester antioxidant as described above. The use of these materials may be particularly desirable when the lubricant formulation contains a combination of titanium and molybdenum materials. For the combination of titanium, molybdenum, and one of the aforementioned hindered phenolic antioxidants, particular benefit may be observed in terms of oxidative stability when the relative amounts of Ti (ppm):Mo (ppm):phenolic antioxidant (percent) are in the ranges such as (20-300):(40-500):(0.3-3) or alternatively (30-200):(50-250):(0.6-1.6) or alternatively (40-150):(60-200):(0.6-1.2), or (40-150):(70-150):(0.7-1.0), or (50-140):(70-150):(0.7-1.0).

Typical amounts of antioxidants in general will, of course, depend on the specific antioxidant and its individual effectiveness, but illustrative total amounts can be 0.01 to 5 percent by weight or 0.15 to 4.5 percent or 0.2 to 4 percent. Additionally, more than one antioxidant may be present, and certain combinations of these can be synergistic in their combined overall effect.

In certain embodiments, when the antioxidant is a hindered phenolic antioxidant or a hindered phenolic ester antioxidant, the amount of such phenolic antioxidant in the lubricant composition may be 0.3 to 3 percent by weight, or 0.7 to 2 percent by weight, or 0.7 to 1.0 percent by weight. Other amounts of the hindered phenolic antioxidant may be 0.6 to 1.6 percent by weight or 0.6 to 1.2 percent by weight or 0.7 to 1.0 percent by weight.

Additional conventional components may be used in preparing a lubricant according to the disclosed technology, for instance, those additives typically employed in a crankcase lubricant. Crankcase lubricants may typically contain any or all of the following components hereinafter described. One such additive is an antiwear agent.

Examples of anti-wear agents include phosphorus-containing anti-wear/extreme pressure agents such as metal thiophosphates, phosphoric acid esters and salts thereof, phosphorus-containing carboxylic acids, esters, ethers, and amides; and phosphites. The phosphorus acids include phosphoric, phosphonic, phosphinic, and thiophosphoric acids including dithiophosphoric acid as well as monothiophosphoric acids, thiophosphinic acids, and thiophosphonic acids. Non-phosphorus-containing anti-wear agents include borated esters, molybdenum-containing compounds, and sulfurized olefins.

Phosphorus acid esters can be prepared by reacting one or more phosphorus acids or anhydrides with an alcohol containing, for instance, 1 to 30 or 2 to 24 or to 12 carbon atoms, including monools and diols and polyols of various types. Such alcohols, including commercial alcohol mixtures, are well known. Examples of these phosphorus acid esters include triphenylphosphate and tricresylphosphate.

In one embodiment, the phosphorus antiwear/extreme pressure agent can be a dithiophosphoric acid or phosphorodithioic acid. The dithiophosphoric acid may be represented by the formula $(RO)_2PSSH$ wherein each R is independently a hydrocarbyl group containing, e.g., 3 to 30 carbon atoms, or up to 18, or 12, or 8 carbon atoms.

Metal salts of the phosphorus acid esters are prepared by the reaction of a metal base with a phosphorus acid ester. The metal base may be any metal compound capable of forming a metal salt. Examples of metal bases include metal oxides, hydroxides, carbonates, sulfates, borates, or the like. The metals of the metal base include Group IA, IIA, IB through VIIB, and VIII metals (CAS version of the Periodic Table of the Elements). These metals include the alkali metals, alkaline earth metals and transition metals. In one embodiment, the metal is a Group IIA metal, such as calcium or magnesium, Group IIB metal, such as zinc, or a Group VIIB metal, such as manganese. In one embodiment, the metal is magnesium, calcium, manganese or zinc. The metal may also be titanium, although in certain embodiments the metal salt is other than a Ti salt.

In one embodiment, phosphorus containing antiwear/extreme pressure agent is a metal thiophosphate, or a metal dithiophosphate. The metal thiophosphate is prepared by means known to those in the art. Examples of metal dithiophosphates include zinc isopropyl methylamyl dithiophosphate, zinc isopropyl isooctyl dithiophosphate, zinc di(cyclohexyl)dithiophosphate, zinc isobutyl 2-ethylhexyl dithiophosphate, zinc isopropyl 2-ethylhexyl dithiophosphate, zinc isobutyl isoamyl dithiophosphate, zinc isopropyl n-butyl dithiophosphate, calcium di(hexyl)dithiophosphate, and barium di(nonyl)dithiophosphate.

Zinc may be supplied to the lubricant from one or more zinc dialkyl-dithiophosphates, from zinc alkylphosphates, or other zinc sources. In certain embodiments the amount of zinc present in the lubricant may be less than or equal to 0.14 percent by weight, or less than 0.09 or 0.035 or 0.01 percent by weight, or the lubricant may be substantially zinc free. In certain embodiments, a small amount of zinc may be present, e.g., at least 0.001 percent by weight or at least 0.01 percent by weight. These upper and lower limits may be combined such that a lubricant may contain, e.g., 0.01 to 0.14 percent by weight zinc.

In one embodiment, the phosphorus containing antiwear agent is a phosphorus containing amide. The phosphorus containing amides may be, for instance prepared by the reaction of a thiophosphoric or dithiophosphoric acid ester with an unsaturated amide. Examples of unsaturated amides include acrylamide, N,N-methylene bis(acrylamide), methacrylamide, crotonamide, and the like. The reaction product of the phosphorus acid and the unsaturated amide may be further reacted with a linking or a coupling compound, such as formaldehyde or paraformaldehyde. The phosphorus containing amides are known in the art and are disclosed in U.S. Pat. Nos. 4,670,169, 4,770,807, and 4,876,374.

In one embodiment, the phosphorus antiwear/extreme pressure agent is a phosphorus containing carboxylic ester contain at least one phosphite. The phosphite may be a di- or trihydrocarbyl phosphite. In one embodiment, each hydrocarbyl group independently contains 1 to 24 carbon atoms, or 1 to 18 or 2 to 8 carbon atoms. Phosphites and their preparation are known and many phosphites are available commercially. Particularly useful phosphites are dibutyl hydrogen phosphite, dioleyl hydrogen phosphite, di($C_{14-18}$) hydrogen phosphite, and triphenyl phosphite.

Other phosphorus-containing antiwear agents include triphenylthio-phosphate, and dithiophosphoric acid ester such as mixed O,O-(2-methylpropyl, amyl)-S-carbomethoxy-ethylphosphorodithioates and O,O-diisooctyl-S-carbo-methoxyethyl-phosphorodithioate.

Such phosphorus-containing antiwear agents are described in greater detail in U.S. Published Application 2003/0092585.

The appropriate amount of the phosphorus-containing antiwear agent will depend to some extent on the particular agent selected and its effectiveness. However, in certain embodiments it may be present in an amount to deliver 0.01 to 0.2 weight percent phosphorus to the composition, or to deliver 0.015 to 0.15 or 0.02 to 0.1 or 0.025 to 0.08 percent phosphorus. For dibutyl hydrogen phosphite, for instance ($(C_4H_9O)_2P(O)H$), which contains about 16 weight percent P, appropriate amounts may thus include 0.062 to 0.56 percent. For a typical zinc dialkyldithiophosphate (ZDP), which may contain 11 percent P (calculated on an oil free basis), suitable amounts may include 0.09 to 0.82 percent. It is believed that the benefits of the disclosed technology may sometimes be more clearly realized in those formulations containing relatively low amounts of ZDP and other sources of zinc, sulfur, and phosphorus, for instance, less than 1200, 1000, 500, 100, or even 50 ppm phosphorus. In one embodiment, the amount of phosphorus is less than 1000 parts per million by weight. In certain embodiments the amount of phosphorus can be 50 to 500 ppm or 50 to 600 ppm.

Other antiwear agents may include dithiocarbamate compounds. In one embodiment, the dithiocarbamate containing composition is derived from the reaction product of a diamylamine or dibutylamine with carbon disulfide which forms a dithiocarbamic acid or a salt which is ultimately reacted with an acrylamide. The amount of this agent, or of the antiwear agents overall, may similarly be as described above for the phosphorus-containing agents, for instance, in certain embodiments 0.05 to 1 percent by weight.

Dispersants are well known in the field of lubricants and include primarily what is known as ashless-type dispersants and polymeric dispersants. Ashless type dispersants are characterized by a polar group attached to a relatively high molecular weight hydrocarbon chain. Typical ashless dispersants include nitrogen-containing dispersants such as N-substituted long chain alkenyl succinimides, having a variety of chemical structures including typically

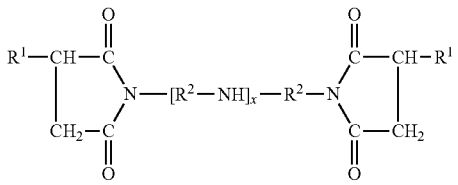

where each $R^1$ is independently an alkyl group, frequently a polyisobutylene group with a molecular weight of 500-5000, and $R^2$ are alkylene groups, commonly ethylene ($C_2H_4$) groups. Such molecules are commonly derived from reaction of an alkenyl acylating agent with a polyamine, and a wide variety of linkages between the two moieties is possible beside the simple imide structure shown above, including a variety of amides and quaternary ammonium salts. Succinimide dispersants are more fully described in U.S. Pat. Nos. 4,234,435 and 3,172,892.

Another class of ashless dispersant is high molecular weight esters. These materials are similar to the above-described succinimides except that they may be seen as having been prepared by reaction of a hydrocarbyl acylating agent and a polyhydric aliphatic alcohol such as glycerol, pentaerythritol, or sorbitol. Such materials are described in more detail in U.S. Pat. No. 3,381,022.

Another class of ashless dispersant is Mannich bases. These are materials which are formed by the condensation of a higher molecular weight, alkyl substituted phenol, an alkylene polyamine, and an aldehyde such as formaldehyde. Such materials may have the general structure

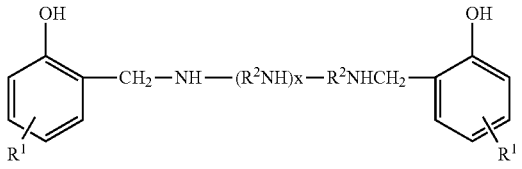

(including a variety of isomers and the like) and are described in more detail in U.S. Pat. No. 3,634,515.

Other dispersants include polymeric dispersant additives, which are generally hydrocarbon-based polymers which contain polar functionality to impart dispersancy characteristics to the polymer.

Dispersants can also be post-treated by reaction with any of a variety of agents. Among these are urea, thiourea, dimercaptothiadiazoles, carbon disulfide, aldehydes, ketones, carboxylic acids, hydrocarbon-substituted succinic anhydrides, nitriles, epoxides, boron compounds, and phosphorus compounds. References detailing such treatment are listed in U.S. Pat. No. 4,654,403.

The amount of dispersant in the present composition can typically be 1 to 10 weight percent, or 1.5 to 9.0 percent, or 2.0 to 8.0 percent, all expressed on an oil-free basis.

In certain embodiments, the disclosed technology includes a metal-containing detergent other than a titanium-containing detergent. Detergents are typically overbased materials. Overbased materials, otherwise referred to as overbased or superbased salts, are generally single phase, homogeneous Newtonian systems characterized by a metal content in excess of that which would be present for neutralization according to the stoichiometry of the metal and the particular acidic organic compound reacted with the metal. The overbased materials are prepared by reacting an acidic material (typically an inorganic acid or lower carboxylic acid, preferably carbon dioxide) with a mixture comprising an acidic organic compound, a reaction medium comprising at least one inert, organic solvent (e.g., mineral oil, naphtha, toluene, xylene) for said acidic organic material, a stoichiometric excess of a metal base (such as a Ca, Mg, Ba, Na, or K compound, among other metals), and a promoter such as a phenol or alcohol. The acidic organic material will normally have a sufficient number of carbon atoms to provide a degree of solubility in oil. The amount of excess metal is commonly expressed in terms of metal ratio. The term "metal ratio" is the ratio of the total equivalents of the metal to the equivalents of the acidic organic compound. A neutral metal salt has a metal ratio of one. A salt having 4.5 times as much metal as present in a normal salt will have metal excess of 3.5 equivalents, or a ratio of 4.5. In certain embodiments, a metal-containing detergent may be present, having a metal ratio of at least 3, at least 8, or at least 10, and up to, for instance, 20 or 15.

In certain embodiments, the presence of a sodium-containing detergent is desirable. In particular, certain combinations of sodium-containing detergents with the titanium-containing materials disclosed herein are particularly useful in providing lubricants with improved deposit control. Deposit control may be measured by the Komatsu Hot Tube (KHT) test, which employs heated glass tubes through which sample lubricant is pumped, approximately 5 mL total sample, typically at 0.31 mL/hour for an extended period of time, such as 16 hours, with an air flow of 10 mL/minute. The glass tube is rated at the end of test for deposits on a scale of 0 (very heavy varnish) to 10 (no varnish). It is observed that the combination of a sodium source such as a sodium-containing detergent with a titanium-containing material gives significantly better tube cleanliness than the presence of either the Na material or the Ti material alone. Suitable concentration of sodium in the lubricant, for such embodiments (which may be contributed by a sodium-containing detergent), include 100 to 2000 parts per million by weight Na, or alternatively 200 to 1000 ppm or 300 to 700 ppm or 400 to 600 ppm. The amount of sodium-containing detergent required to supply such amounts of sodium will depend on the amount of sodium in the detergent, which will normally be influenced, for instance, by the extent of overbasing and metal ratio of the detergent. These variables will be well understood by the person skilled in the art. In certain such embodiments, the concentration of titanium, when used in combination with the sodium, may be 20 to 200 parts per million by weight or 30 to 100 ppm or 40 to 80 ppm. The presence of sodium may be beneficial, however, at any of the concentrations of titanium described herein and may be beneficial in the presence or in the absence of any of the other lubricating components disclosed herein as being useful in combination with the titanium-containing materials.

Overbased materials are well known to those skilled in the art. Patents describing techniques for making basic salts of sulfonic acids such as long chain alkylbenzenesulfonic acids (or corresponding alkyltoluenesulfonic acids), carboxylic acids, phenols, including overbased phenol sulfides (sulfur-bridged phenols), phosphonic acids, and mixtures of any two or more of these include U.S. Pat. Nos. 2,501,731; 2,616,905; 2,616,911; 2,616,925; 2,777,874; 3,256,186; 3,384,585; 3,365,396; 3,320,162; 3,318,809; 3,488,284; and 3,629,109.

Detergents based on other, or more specific, acidic substrates include salicylates, salixarates, and saligenins. Typical salicylate detergents are metal overbased salicylates having a sufficiently long hydrocarbon substituent to promote oil solubility. Hydrocarbyl-substituted salicylic acids can be prepared by the reaction of the corresponding phenol by reaction of an alkali metal salt thereof with carbon dioxide. The hydrocarbon substituent can be as described for the carboxylate or phenate detergents. Overbased salicylic acid detergents and their preparation are described in greater detail in U.S. Pat. No. 3,372,116.

Salixarate and saligenin derivative detergents are described in greater detail in US Published Application 2004/0102335. Saligenin detergents can be represented by the formula:

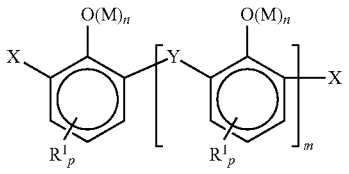

wherein X comprises —CHO or —$CH_2OH$, Y comprises —$CH_2$— or —$CH_2OCH_2$—, and wherein, in typical embodiments, such —CHO groups comprise at least 10 mole percent of the X and Y groups; and M is a valence of a metal ion, typically mono- or di-valent. Each n is independently 0 or 1. R1 is a hydrocarbyl group typically containing 1 to 60 carbon atoms, m is 0 to 10, and when m>0, one of the X groups can be H; each p is independently 0, 1, 2 or 3, preferably 1; and that the total number of carbon atoms in all $R^1$ groups is typically at least 7. When n is 0, M is replaced by H to form an unneutralized phenolic —OH group. Preferred metal ions M are monovalent metals ion such as lithium, sodium, potassium, as well as divalent ions such as calcium or magnesium. Saligenin derivatives and methods of their preparation are described in greater detail in U.S. Pat. No. 6,310,009.

Salixarate detergents can be represented by a substantially linear compound comprising at least one unit of formula (I) or formula (II):

(I)

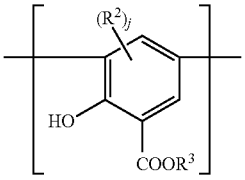

-continued (II)

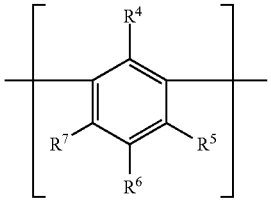

each end of the compound having a terminal group of formula (III) or formula (IV):

(III)

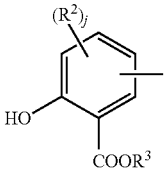

(IV)

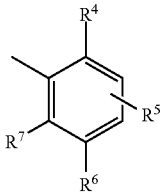

such groups being linked by divalent bridging groups A, which may be the same or different for each linkage. In the above formulas (I)-(IV) $R^3$ is hydrogen or a hydrocarbyl group; $R^2$ is hydroxyl or a hydrocarbyl group, and j is 0, 1, or 2; $R^6$ is hydrogen, a hydrocarbyl group, or a hetero-substituted hydrocarbyl group; and either $R^4$ is hydroxyl and $R^5$ and $R^7$ are independently either hydrogen, a hydrocarbyl group, or hetero-substituted hydrocarbyl group, or else $R^5$ and $R^7$ are both hydroxyl and $R^4$ is hydrogen, a hydrocarbyl group, or a hetero-substituted hydrocarbyl group; provided that at least one of $R^4$, $R^5$, $R^6$ and $R^7$ is hydrocarbyl containing at least 8 carbon atoms; and wherein the molecules on average contain at least one of unit (I) or (III) and at least one of unit (II) or (IV) and the ratio of the total number of units (I) and (III) to the total number of units of (II) and (IV) in the composition is 0.1:1 to 2:1. The divalent bridging group "A," which may be the same or different in each occurrence, includes —$CH_2$— (methylene bridge) and —$CH_2OCH_2$— (ether bridge), either of which may be derived from formaldehyde or a formaldehyde equivalent (e.g., paraform, formalin). Salixarate derivatives and methods of their preparation are described in greater detail in U.S. Pat. No. 6,200,936 and PCT Publication WO 01/56968. It is believed that the salixarate derivatives have a predominantly linear, rather than macrocyclic, structure, although both structures are intended to be encompassed by the term "salixarate."

The amount of the detergent can typically be 0.1 to 5.0 percent by weight on an oil free basis. Since many detergents contain 30-50 percent diluent oil, this would correspond to, for instance, about 0.2 to 12 percent by weight of the commercially available, oil-diluted detergents. In other embodiments, the amount of detergent can be 0.2 to 4.0 percent by weight or 0.3-3.0 percent by weight (oil-free). In certain embodiments, where sodium-containing detergents are employed, the detergent may be an overbased sodium sulfonate detergent, and its amount may be 0.05 to 0.5 weight percent, or 0.1 to 0.3, or 0.15 to 0.25 weight percent (oil-free).

It will be evident that the detergent may be based on any of the afore-mentioned metals as well as other metals generally. Thus, titanium based detergents are also possible. Thus, while certain detergents may contain titanium, in certain embodiments the detergent which may be present is other than a titanium-containing detergent. That is, although a Ti-containing detergent may or may not be present in the lubricant, in certain embodiments a different, or additional detergent may be present which does not contain titanium. Of course, it is recognized that the metal ions within a lubricant may migrate from one detergent to another, so that if a detergent other than a titanium detergent is initially added, after a period of time some of the molecules thereof may become associated with a Ti ion. The presence of a detergent other than a Ti-containing detergent is to be interpreted as not to be negated by the presence of such incidental, transferred Ti ions in such detergent.

Viscosity improvers (also sometimes referred to as viscosity index improvers or viscosity modifiers) may be included in the compositions of this invention. Viscosity improvers are usually polymers, including polyisobutenes, polymethacrylic acid esters, hydrogenated diene polymers, polyalkyl styrenes, esterified styrene-maleic anhydride copolymers, hydrogenated alkenylarene-conjugated diene copolymers and polyolefins. Multifunctional viscosity improvers, other than those of the disclosed technology, which also have dispersant and/or antioxidancy properties are known and may optionally be used in addition to the products of this invention.

Other additives that may optionally be used in the lubricating oils of this invention include pour point depressing agents, extreme pressure agents, anti-wear agents, color stabilizers and anti-foam agents.

Extreme pressure agents and corrosion and oxidation inhibiting agents which may be included in the compositions of the invention are exemplified by chlorinated aliphatic hydrocarbons, organic sulfides and polysulfides, phosphorus esters including dihydrocarbon and trihydrocarbon phosphites, and molybdenum compounds.

The various additives described herein can be added directly to the lubricant. In one embodiment, however, they can be diluted with a concentrate-forming amount of a substantially inert, normally liquid organic diluent such as mineral oil or a synthetic oil such as a polyalphaolefin to form an additive concentrate. These concentrates usually comprise 0.1 to 80% by weight of the compositions of this invention and may contain, in addition, one or more other additives known in the art or described hereinabove. Concentrations such as 15%, 20%, 30% or 50% of the additives or higher may be employed. By a "concentrate forming amount" is generally mean an amount of oil or other solvent less than the amount present in a fully formulated lubricant, e.g., less than 85% or 80% or 70% or 60%. Additive concentrates can be prepared by mixing together the desired components, often at elevated temperatures, usually up to 150° C. or 130° C. or 115° C.

The lubricating compositions of the disclosed technology may thus impart protection against deterioration in one or more of the properties of engine performance, engine wear, engine cleanliness, deposit control, filterability, and oxidation of engine oils, when they are used to lubricate a surface of a mechanical device such as an engine drive train, for instance, the moving parts of a drive train in a vehicle including an internal surface a component of an internal combustion engine. Such a surface may then be said to contain a coating of the lubricant composition.

The internal combustion engines to be lubricated may include gasoline fueled engines, spark ignited engines, diesel engines, compression ignited engines, two-stroke cycle engines, four-stroke cycle engines, sump-lubricated engines, fuel-lubricated engines, natural gas-fueled engines, marine diesel engines, and stationary engines. The vehicles in which such engines may be employed include automobiles, trucks, off-road vehicles, marine vehicles, motorcycles, all-terrain vehicles, and snowmobiles. In one embodiment, the lubricated engine is a heavy duty diesel engine, which may include sump-lubricated, two- or four-stroke cycle engines, which are well known to those skilled in the art. Such engines may have an engine displacement of greater than 3, greater than 5, or greater than 7 L.

As used herein, the term "hydrocarbyl substituent" or "hydrocarbyl group" is used in its ordinary sense, which is well-known to those skilled in the art. Specifically, it refers to a group having a carbon atom directly attached to the remainder of the molecule and having predominantly hydrocarbon character. Examples of hydrocarbyl groups include:

hydrocarbon substituents, that is, aliphatic (e.g., alkyl or alkenyl), alicyclic (e.g., cycloalkyl, cycloalkenyl) substituents, and aromatic-, aliphatic-, and alicyclic-substituted aromatic substituents, as well as cyclic substituents wherein the ring is completed through another portion of the molecule (e.g., two substituents together form a ring);

substituted hydrocarbon substituents, that is, substituents containing non-hydrocarbon groups which, in the context of this invention, do not alter the predominantly hydrocarbon nature of the substituent (e.g., halo (especially chloro and fluoro), hydroxy, alkoxy, mercapto, alkylmercapto, nitro, nitroso, and sulfoxy);

hetero substituents, that is, substituents which, while having a predominantly hydrocarbon character, in the context of this invention, contain other than carbon in a ring or chain otherwise composed of carbon atoms. Heteroatoms include sulfur, oxygen, nitrogen, and encompass substituents as pyridyl, furyl, thienyl and imidazolyl. In general, no more than two, preferably no more than one, non-hydrocarbon substituent will be present for every ten carbon atoms in the hydrocarbyl group; typically, there will be no non-hydrocarbon substituents in the hydrocarbyl group.

It is known that some of the materials described above may interact in the final formulation, so that the components of the final formulation may be different from those that are initially added. For instance, metal ions (of, e.g., a detergent) can migrate to other acidic or anionic sites of other molecules. The products formed thereby, including the products formed upon employing the composition of the disclosed technology in its intended use, may not be susceptible of easy description. Nevertheless, all such modifications and reaction products are included within the scope of the disclosed technology; the disclosed technology encompasses the composition prepared by admixing the components described above.

EXAMPLES

Formulation A. A lubricant formulation is prepared in the absence and presence of added titanium. The formulation contains the following components:

- 100 parts by weight of API Group 2 base stocks, 130 N and 260 N;
- 15 parts commercial styrene-isoprene viscosity modifier, including diluent oil component present in the commercial material;
- 0.2 parts of an esterified maleic anhydride/styrene copolymer pour point depressant (containing about 54% diluent oil)

7.2 parts of a succinimide dispersant (including 50% diluent oil)
3.04 parts multiple overbased calcium sulfonate, phenate, and salixarate detergents (each including 27% to 51% diluent oil)
1.51 parts antioxidants (sulfurized olefin—sulfurized Diels-Alder adduct), hindered phenolic ester, and di(alkylaryl) amine
0.98 parts zinc di(secondary)alkyldithiophosphate (including 9% diluent oil)
0.01 parts commercial antifoam agent
1.05 parts additional diluent oil The above formulation is top-treated with titanium isopropoxide to give Ti concentrations in the amounts shown in the Table below.

| Example | Ti, ppm |
|---|---|
| 1 (reference) | 0 |
| 2 | 10 |
| 3 | 25 |
| 4 | 37 |
| 5 | 65 |
| 6 | 96 |

Formulation B. A lubricant formulation is prepared in the absence and presence of added titanium. The formulation contains the following components:
93 parts by weight of API Group 2 base stocks, SAE-30;
2.8 parts of a succinimide dispersant (including 49% diluent oil)
0.7 parts zinc di(secondary)alkyldithiophosphate (including 9% diluent oil)
3.1 parts multiple overbased calcium sulfonate and phenate detergents (each including 27% to 52% diluent oil)
0.2 parts commercial phenolic antioxidant
0.008 parts commercial antifoam agent
0.1 parts additional diluent oil To Formulation B is added the amount of titanium isopropoxide as indicated in the following table:

| Example | Ti isopropoxide, parts | Ti, ppm, calculated |
|---|---|---|
| 10 (ref.) | 0 | 0 |
| 11 | 0.0050 | 8 |
| 12 | 0.010 | 17 |
| 13 | 0.020 | 34 |
| 14 | 0.040 | 67 |
| 15 | 0.060 | 101 |

Formulation C. A stationary gas engine lubricant formulation is prepared in the absence and presence of added titanium. The formulation contains the following components:
100 parts by weight of API Group 2 base stocks, 600N;
4.24 parts of a succinimide dispersant (including 40% diluent oil)
0.30 parts zinc di(secondary)alkyldithiophosphate (including 9% diluent oil)
2.48 parts overbased calcium sulfonate and phenate detergents (each including 27% to 47% diluent oil)
2.06 parts commercial antioxidants
0.007 parts commercial antifoam agent
0.29 parts additional diluent oil To Formulation C is added the amount of titanium isopropoxide as indicated in the following table:

| Example | Ti isopropoxide, parts |
|---|---|
| 16 (ref.) | 0 |
| 17 | 0.020 |
| 18 | 0.040 |
| 19 | 0.060 |

To the various examples prepared from Formulation A, Formulation B, or Formulation C are added 40, 70, 150, 250, or 500 parts per million by weight of molybdenum (added as a molybdenum dithiocarbamate) and 0.3, 0.6, 1.0, 1.6 or 3.0 percent by weight of a hindered phenolic ester antioxidant.

To the various examples prepared from Formulation A, Formulation B, or Formulation C are added 0.1, 0.2, 0.3, 0.4, 0.7, 1.5, or 2 percent by weight of oleyl tartrimide or a C12-14 ester of tartaric acid.

To the various examples prepared from Formulation A, Formulation B, or Formulation C are added a sodium-containing detergent in an amount to contribute 100, 200, 300, 400, 700, 1000, or 2000 parts per million sodium.

Formulations are also, separately, prepared as each of the examples reported in the preceding paragraphs, except that the titanium isopropoxide in each example is replaced by titanium 2-ethylhexoxide providing the same respective amount of titanium in the formulation. (The weight percent of the titanium 2-ethylhexoxide will be about twice the amount of the titanium isopropoxide.)

Examples 20-27

Base lubricant formulation D is prepared with the following components:
—Group III base oil(s), in an amount to total 100%
7% Olefin copolymer viscosity modifier, including 90% oil
0.2% Polymeric pour point depressant, including 54% oil
1.8% Overbased Ca sulfonate detergent(s), including 42-47% oil
4.5% Succinimide dispersant, including 47% oil
0.86% Zinc dialkyldithiophosphate(s), about 10% P, including 8-9% oil
0.1% Hydroxyacid derivative friction modifier
0.01% Commercial antifoam agent (including diluent)
1.35% Antioxidants (aromatic amine and sulfurized olefin)
0.6% Hindered phenolic ester antioxidant (C4 ester)
0.25% Overbased sodium sulfonate detergent, 19.4% Na, including 31% oil.

This base lubricant (which already contains 0.6% hindered phenolic ester antioxidant) is top treated with the components as shown in the following table:

| | Ex: | | | | | | | |
|---|---|---|---|---|---|---|---|---|
| Additive | 20 | 21 | 22 | 23 | 24 | 25 | 26 | 27 |
| Ti 2-ethylhexyloxide, % | — | 0.28 | | | 0.14 | | 0.14 | 0.093 |
| (Ti, ppm) | | 240 | | | 120 | | 120 | 80 |
| Sakuralube ™ 525 commercial Mo dithiocarbamate, % | — | | | 0.24 | | 0.12 | 0.12 | 0.08 |

-continued

| Additive | Ex: 20 | 21 | 22 | 23 | 24 | 25 | 26 | 27 |
|---|---|---|---|---|---|---|---|---|
| (Mo, ppm) | | | | 240 | | 120 | 120 | 80 |
| Hindered phenolic ester antioxidant (C4 ester) % | — | | 1.0 | | 0.5 | 0.5 | | 0.33 |
| (total C4 ester) | 0.6 | 0.6 | 1.6 | 0.6 | 1.1 | 1.1 | 0.6 | 0.93 |

The lubricants of examples 21 through 27 are tested for oxidative stability through two pressurized differential scanning calorimetry (PDSC) measurements. Each test measures the time at which significant oxidation commences. Test I uses about 3 mg of sample and 3.5 MPa (500 psi) oxygen under a flow of 30 mL/min, starting at 40° C., increasing to an elevated holding temperature. Test II (known as L85-99) uses 2.8-3.2 mg of sample and 690 kPa (100 psi) air (static), starting at 50° C., increasing at 40° C./min to a holding temperature of 210° C. Results of testing are shown in the following table:

| Induction time | Ex: 20 | 21 | 22 | 23 | 24 | 25 | 26 | 27 |
|---|---|---|---|---|---|---|---|---|
| Test I (min.) | 67.3 | 78.9 | 75.4 | 183.2 | 74.0 | 157.3 | 200.1 | 202.7 |
| Test II (min.) | 105.3 | 156.4 | 109.7 | 176.4 | 134.9 | 173.6 | 202.5 | 209.4 |

The best results are obtained for the samples which contain the combination of 80-120 ppm Ti, 80-120 ppm Mo, and 0.6 to 0.93 hindered phenolic antioxidant (Examples 26 and 27).

Examples 28-31

Base lubricant formulation E is prepared with the following components (all presented on an oil-free basis):

—Base oil(s), API Group III, in an amount to total 100%

1.72% Polymeric viscosity modifier 0.09% Polymeric pour point depressant 0.89% Overbased Ca sulfonate detergent(s)

2.17% Succinimide dispersant 0.52% Zinc dialkyldithiophosphate(s), about 11% P 0.01% Commercial antifoam agent (including diluent)

0.79% Antioxidants (aromatic amine and sulfurized olefin)

1.0% Hindered phenolic C-4 ester antioxidant

This base lubricant is top-treated with components as shown in the following table:

| Additive | Ex: 28 | 29 | 30 | 31 |
|---|---|---|---|---|
| Titanium 2-ethylhexoxide, % | — | | 0.71 | 0.71 |
| (Ti, ppm) | | | 600 | 600 |
| Tartrate ester (w/ mixed C12, 13,14 alcohols) | — | 0.50 | | 0.50 |

The lubricant formulations are subjected to a PDSC oxidation onset test, L85-99, described above. The results are shown in the following table:

| | Ex: 28 | 29 | 30 | 31 |
|---|---|---|---|---|
| Induction time, min. | 67 | 83 | 83 | 106 |

The results show that, while both Ti alone and tartrate ester alone impart some improvement in oxidative resistance, the presence of both materials imparts an unexpectedly large increase in induction time. This effect is not observed at 100 ppm Ti.

Examples 32-37

Base lubricant formulation F is prepared with the following components (all presented on an oil-free basis):

—Base oil(s), API Groups II and III, in an amount to total 100%

0.57% Olefin copolymer viscosity modifier 0.14% Polymeric pour point depressant 0.79% Zinc dialkyldithiophosphate(s), about 11% P 0.01% Commercial antifoam agent (including diluent)

0.99% Antioxidants (aromatic amine, sulfurized olefin)

0.25% Hindered phenolic C-4 ester antioxidant 0.1% Hydroxyacid derivative friction modifier This base lubricant is further treated with components as shown in the following table:

| Additive | Ex: 32 | 33 | 34 | 35 | 36 | 37 |
|---|---|---|---|---|---|---|
| Succinimide dispersant (no Ti), % | 2.12 | 2.12 | | | | |
| Titanated succinimide dispersant 1, % | | | 2.12 | 2.12 | | |
| Titanated succinimide dispersant 2, % | | | | | 2.12 | 2.12 |
| (ppm Ti) | | | 80 | 80 | 40 | 40 |
| Overbased Ca sulfonate detergent, % | 0.9 | 0.74 | 0.9 | 0.74 | 0.9 | 0.74 |
| Overbased Na sulfonate detergent, % | | 0.17 | | 0.17 | | 0.17 |
| (ppm Na) | | 423 | | 463 | | 420 |

The lubricant formulations are subjected to the Komatsu Hot Tube test, a high temperature test measuring deposit formation. Glass tubes in a heated aluminum block maintained at 280° C. Test oil is flowed through the tubes at 0.31 mL/hour under an air flow of 10 mL/min., over the course of 16 hours. At the end of the test, the tubes are rinsed and rated visually on a 0-10 scale, with 0 being a black tube and 10 being a clean tube. The results are shown in the following table:

| | Ex: | | | | | |
|---|---|---|---|---|---|---|
| Additive | 32 | 33 | 34 | 35 | 36 | 37 |
| KHT Rating | 0.5 | 0 | 3 | 9 | 3.5 | 9 |

The results show that the presence of Na detergent has no effect on deposits by the KHT test. The presence of Ti alone (at 40 or 80 ppm) has a modest effect, improving the rating to 3-3.5. However, the combination of Ti+Na leads to a dramatic improvement, to ratings of 9.

Each of the documents referred to above is incorporated herein by reference. Except in the Examples, or where otherwise explicitly indicated, all numerical quantities in this description specifying amounts of materials, reaction conditions, molecular weights, number of carbon atoms, and the like, are to be understood as modified by the word "about." It is to be understood that the upper and lower amount, range, and ratio limits set forth herein may be independently combined. Similarly, the ranges and amounts for each element of the invention can be used together with ranges or amounts for any of the other elements. As used herein, the expression "consisting essentially of" permits the inclusion of substances that do not materially affect the basic and novel characteristics of the composition under consideration.

What is claimed is:

1. A lubricating composition comprising:

(a) an oil of lubricating viscosity;

(b) about 20 to about 300 parts per million by weight of titanium in the form of an oil-soluble titanium-containing material which comprises the reaction product of a titanium alkoxide and a hydrocarbyl-substituted succinic anhydride, which titanium material is not a dimeric or oligomeric compound and has a number average molecular weight of about 1000 or less;

(c) about 40 to about 500 parts per million by weight molybdenum in the form of an oil-soluble molybdenum-containing material;

(d) about 0.3 to about 3 percent by weight of a hindered phenolic antioxidant; and at least one additive selected from the group consisting of:

(e) anti-wear agents and (f) dispersants.

2. The lubricating composition of claim 1 wherein the amount of titanium is about 50 to about 140 parts per million by weight.

3. The lubricating composition of claim 1 wherein the oil-soluble molybdenum-containing material comprises a molybdenum hydrocarbyldithio-carbamate.

4. The lubricating composition of claim 1 wherein the amount of molybdenum is about 70 to about 150 parts per million by weight.

5. The lubricating composition of claim 1 wherein the phenolic antioxidant comprises a hindered phenolic ester antioxidant.

6. The lubricating composition of claim 1 wherein the amount of phosphorus in said composition is less than about 1000 parts per million by weight.

7. The lubricating composition of claim 1 wherein the amount of titanium in the lubricating composition is about 50 to about 140 parts per million by weight, the amount of molybdenum in the lubricating composition is about 70 to about 150 parts per million by weight, the hindered phenolic antioxidant comprises a hindered phenolic ester antioxidant and is present in an amount of about 0.7 to about 2.0 percent by weight, and the amount of phosphorus in the lubricating composition is less than about 1000 parts per million by weight.

8. The lubricating composition of claim 1 further comprising (g) a sodium-containing detergent in an amount to contribute about 100 to about 2000 parts per million weight sodium to the composition.

9. The lubricating composition of claim 1 further comprising (h) about 0.1 to about 2.0 weight percent of a component comprising a hydroxycarboxylic acid or an ester, amide, imide, or salt thereof, or a derivative thereof with multiple of the foregoing functionalities.

10. A lubricating composition comprising:

(a) an oil of lubricating viscosity;

(b) about 200 to about 2000 parts per million by weight of titanium in the form of an oil-soluble titanium-containing material which comprises the reaction product of a titanium alkoxide and a hydrocarbyl-substituted succinic anhydride, which titanium material is not a dimeric or oligomeric compound and has a number average molecular weight of about 1000 or less; and (h) about 0.1 to about 2.0 weight percent of a component comprising a hydroxy-carboxylic acid or an ester, amide, imide, or salt thereof, or a derivative thereof with multiple of the foregoing functionalities.

11. The lubricating composition of claim 10 wherein the component of (h) comprises tartaric acid, malic acid, or citric acid or an ester, amide, imide, or salt thereof.

12. The lubricating composition of claim 10 wherein the component of (h) comprises oleyl tartrimide or a diester of tartaric acid and one or more alcohols of about 8 to about 18 carbon atoms.

13. The lubricating composition of claim 10 further comprising (g) a metal-containing detergent other than a Ti-containing detergent.

14. The lubricating composition of claim 13 wherein the metal-containing detergent comprises a sodium-containing detergent.

15. A lubricating composition comprising:

(a) an oil of lubricating viscosity;

(b) about 20 to about 200 parts per million by weight of titanium in the form of an oil-soluble titanium-containing material which comprises the reaction product of a titanium alkoxide and a hydrocarbyl-substituted succinic anhydride, which titanium material is not a dimeric or oligomeric compound and has a number average molecular weight of about 1000 or less; and (g) a sodium-containing detergent in an amount to contribute about 100 to about 2000 parts per million weight sodium to the composition.

16. A method for lubricating an internal combustion engine, comprising supplying to said engine the lubricating composition of claim 1.

* * * * *